US005377451A

United States Patent [19]

Leoni et al.

[11] Patent Number: 5,377,451

[45] Date of Patent: Jan. 3, 1995

[54] WAFER POLISHING APPARATUS AND METHOD

[75] Inventors: Fabrizio Leoni; Marco Morganti; Luigi Vesco, all of Novara, Italy

[73] Assignee: MEMC Electronic Materials, Inc., St. Peters, Mo.

[21] Appl. No.: 21,215

[22] Filed: Feb. 23, 1993

[51] Int. Cl.[6] ..... B24B 7/22

[52] U.S. Cl. ..... 451/287; 451/290

[58] Field of Search ..... 51/131.4, 131.5, 131.1, 51/237 R, 283 R, 134, 132

[56] References Cited

U.S. PATENT DOCUMENTS

| | | | |
|---|---|---|---|
| 3,631,634 | 1/1972 | Weber | 51/131.4 |
| 3,708,921 | 1/1973 | Cronkhite et al. | 51/131 |
| 3,841,031 | 10/1974 | Walsh | 51/283 |
| 3,857,123 | 12/1974 | Walsh | 51/131 |
| 4,194,324 | 3/1980 | Bonora | 51/131.5 |
| 4,270,316 | 6/1981 | Krämer et al. | 51/283 R |
| 4,313,284 | 2/1982 | Walsh | 51/131.4 |
| 4,316,757 | 2/1982 | Walsh | 156/286 |
| 4,450,652 | 5/1984 | Walsh | 51/131.4 |
| 4,811,522 | 3/1989 | Gill, Jr. | 51/131.4 |
| 4,918,870 | 4/1990 | Torbert et al. | 51/131.3 |
| 5,193,316 | 3/1993 | Olmstead | 51/131.4 |

FOREIGN PATENT DOCUMENTS

| | | | |
|---|---|---|---|
| 0062668 | 3/1988 | Japan | 51/131.4 |

*Primary Examiner*—Robert A. Rose

*Attorney, Agent, or Firm*—Senniger, Powers, Leavitt & Roedel

[57] ABSTRACT

Wafer polishing apparatus includes a turntable having a polishing surface thereon, and a frame mounting the turntable for rotation relative to the frame about an axis. A pressure plate mounted by a spindle rotates about an axis spaced from the axis of rotation of the turntable, but is held from rotation about the axis of rotation of the turntable. The pressure plate is constructed for simultaneously holding multiple wafers with a polish face of the wafers facing the polishing surface of the turntable. The wafers are pressed against the polishing surface of the turntable by a cylinder which applies a force to the pressure plate. A floating head assembly operatively connecting the wafers to the pressure plate reorients the wafer relative to the pressure plate in response to pressure differentials over the polish face of the wafer engaging the polishing surface to substantially equalize the pressure distribution over the polish face of the wafer.

17 Claims, 5 Drawing Sheets

WAFER POLISHING APPARATUS AND METHOD

BACKGROUND OF THE INVENTION

This invention relates to apparatus for polishing semiconductor or similar type materials, and more specifically to such apparatus which permits batch processing of the wafers with improved uniformity, throughput and yield.

Polishing an article to produce a surface which is highly reflective and damage free has application in many fields. A particularly good finish is required when polishing an article such as a wafer of semiconductor material in preparation for printing circuits on the wafer by an electron beam-lithographic or photolithographic process. Flatness of the wafer surface on which circuits are to be printed is critical in order to maintain resolution of the lines, which can be as thin as 1 micron or less. The need for a flat wafer surface, and in particular local flatness in discrete areas on the surface, is heightened when stepper lithographic processing is employed.

Flatness is quantified in part by a total thickness variation measurement (TTV) and site total indicated reading (STIR). TTV is the difference between the maximum and minimum thicknesses of the wafer. STIR is the sum of the maximum positive and negative deviations of the surface in a small area of the wafer from a reference plane, referred to as the "focal" plane. Total thickness variation in the wafer is a critical indicator of the quality of the polish of the wafer. Presently, flatness of the polish surfaces of the wafers are not significantly improved and may be worsened by the polishing process. In batch processing, there will be a significant number of wafers which fail to meet flatness and polishing specifications after polishing, thus adversely affecting yield in commercial production.

Conventional polishing machines include an annular polishing pad mounted on a turntable for driven rotation about a vertical axis passing through the center of the pad. The wafers are fixedly mounted on pressure plates above the polishing pad and lowered into polishing engagement with the rotating polishing pad. A polishing slurry, typically including chemical polishing agents and abrasive particles, is applied to the pad.

In order to achieve the degree of polishing needed, a substantial normal force presses the wafers into engagement with the pad. The coefficient of friction between the pad and wafer is quite high, oftentimes in the vicinity of two. These high forces can give rise to certain distortions in the polish, such as by creating a vertical component of the frictional force at the leading edge of a wafer as it encounters an area of particularly high frictional interaction with the polishing pad. A change in the net vertical force applied to the wafer locally changes the polishing pressure and the polishing rate of the wafer, giving rise to distortions in the polish.

Where batch processing is employed, several wafers are rigidly mounted to a single pressure plate. Different regions of the polish face engaging the polishing pad travel along separate paths because the wafers are rigidly attached to the pressure plate. A discontinuity in the pad (e.g., a small lump or an area of glazed slurry) may repeatedly encounter one region of the wafer and not another, causing an imperfection in the polish in the one region. Further, forces and vibrations which are generated by the interaction of one wafer with the polishing pad are transmitted through the rigid structure of the pressure plate to undesirably affect the polishing rate and mechanical characteristics of other wafers on the pressure plate. Moreover, wafers to be polished by batch process must be presorted so that all wafers to be mounted at one time on a single pressure plate are of the same thickness to a high degree of accuracy. Otherwise, the pressure plate is tilted from the horizontal enough to introduce a nonuniform application of pressure to the wafers on the plate, causing undesirable variations in the polish finish between wafers mounted on the same pressure plate and over the polish surface of a single wafer.

The problems of yield associated with batch processing are somewhat alleviated by single wafer processing, in which each wafer has its own pressure plate. Single wafer processing eliminates the problems of forces transmitted through the pressure plate from one wafer to another. However, single wafer polishing has a very low throughput because only a single wafer per pressure plate is polished at a time.

SUMMARY OF THE INVENTION

Among the several objects and features of the present invention may be noted the provision of a wafer polishing apparatus and method which improve the flatness of the wafers processed; the provision of such apparatus and method which increase yield in batch wafer polishing; the provision of such apparatus and method in which pressure applied to each wafer is substantially the same; the provision of such apparatus and method which permit batch polishing of wafers without regard to thickness variations between wafers mounted at one time on one pressure plate of the polishing apparatus; the provision of such apparatus and method which tends to average out the effect on the polish face of the wafer caused by a discontinuity in the pad; and the provision of such apparatus and method which move the wafers in a smooth and vibration-free manner.

Generally, wafer polishing apparatus constructed according to the principles of the present invention comprises a turntable having a polishing surface and a frame mounting the turntable for rotation relative to the frame about an axis. A pressure plate is mounted by spindle means for rotation about axes spaced from the axis of rotation of the turntable, with the pressure plate being held from rotation about the axis of rotation of the turntable. The pressure plate is constructed for simultaneously holding multiple wafers with a polish face of the wafers facing the polishing surface of the turntable. Force applicating means applies a force to the pressure plate to press the wafers against the polishing surface of the turntable. Means operatively connecting each wafer to the pressure plate is operable to reorient the wafer relative to the pressure plate in response to pressure differentials over the polish face of the wafer engaging the polishing surface to substantially equalize the pressure distribution over the polish face of the wafer.

Generally, a method of polishing an article such as a wafer made of semiconductor material according to the present invention includes providing a plurality of wafers to be polished. The wafers are releasably mounted on a pressure plate of a polishing machine in a generally free-floating relationship with respect to the pressure plate. Polish faces of the wafers are pressed, via application of force to the pressure plate, against the polishing surface of the turntable, and the wafers are oriented with respect to the pressure plate (and independently of the other wafers) in response to detected pressure differentials over the polish face of the wafer to substantially equalize the pressure over the polish face of the wafer.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
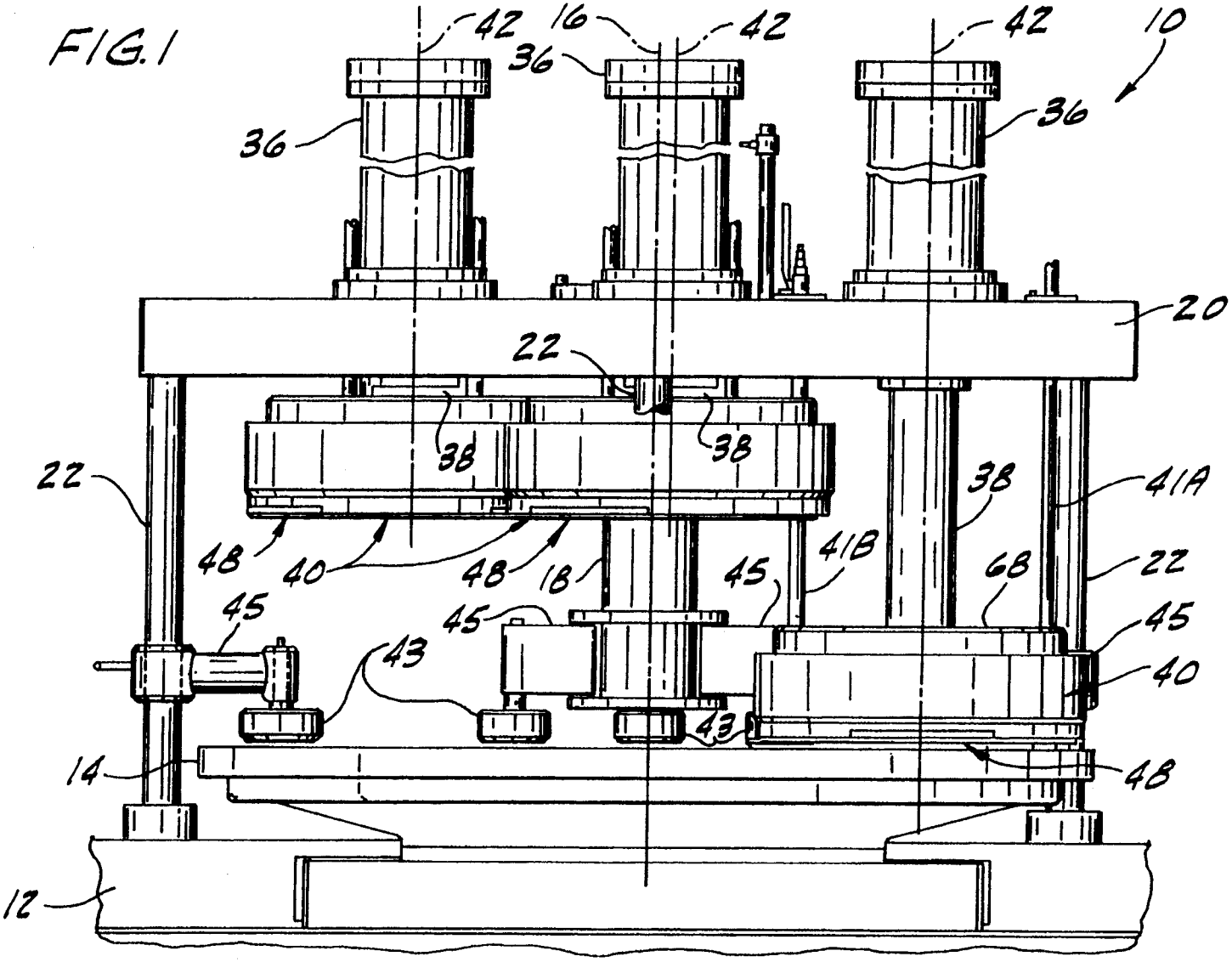
FIG. 1 is a fragmentary elevation of polishing apparatus showing two pressure plates in raised position (a third raised pressure plate of identical construction being concealed by the two shown), and another pressure plate in a lowered or polishing position.

Referring now to the drawings and in particular to FIG. 1, polishing apparatus 10 constructed according to the principles of the present invention is shown to comprise a frame 12 mounting a turntable 14 for rotation with respect to the frame about a turntable axis 16. The frame 12 includes columns 22 extending up from the frame to mount an overhead support 20 above the turntable. The overhead support 20 mounts four hydraulic cylinders 36 having arms 38 to which are attached pressure plates generally indicated at 40. Only three cylinders 36 and pressure plates 40 are shown in FIG. 1, the fourth cylinder and pressure plate, which are of the same construction as those illustrated, are hidden in this view. Cooling fluid may be circulated through the plates by inlet and outlet pipes, designated 41A and 41B, respectively.

Figure 5:
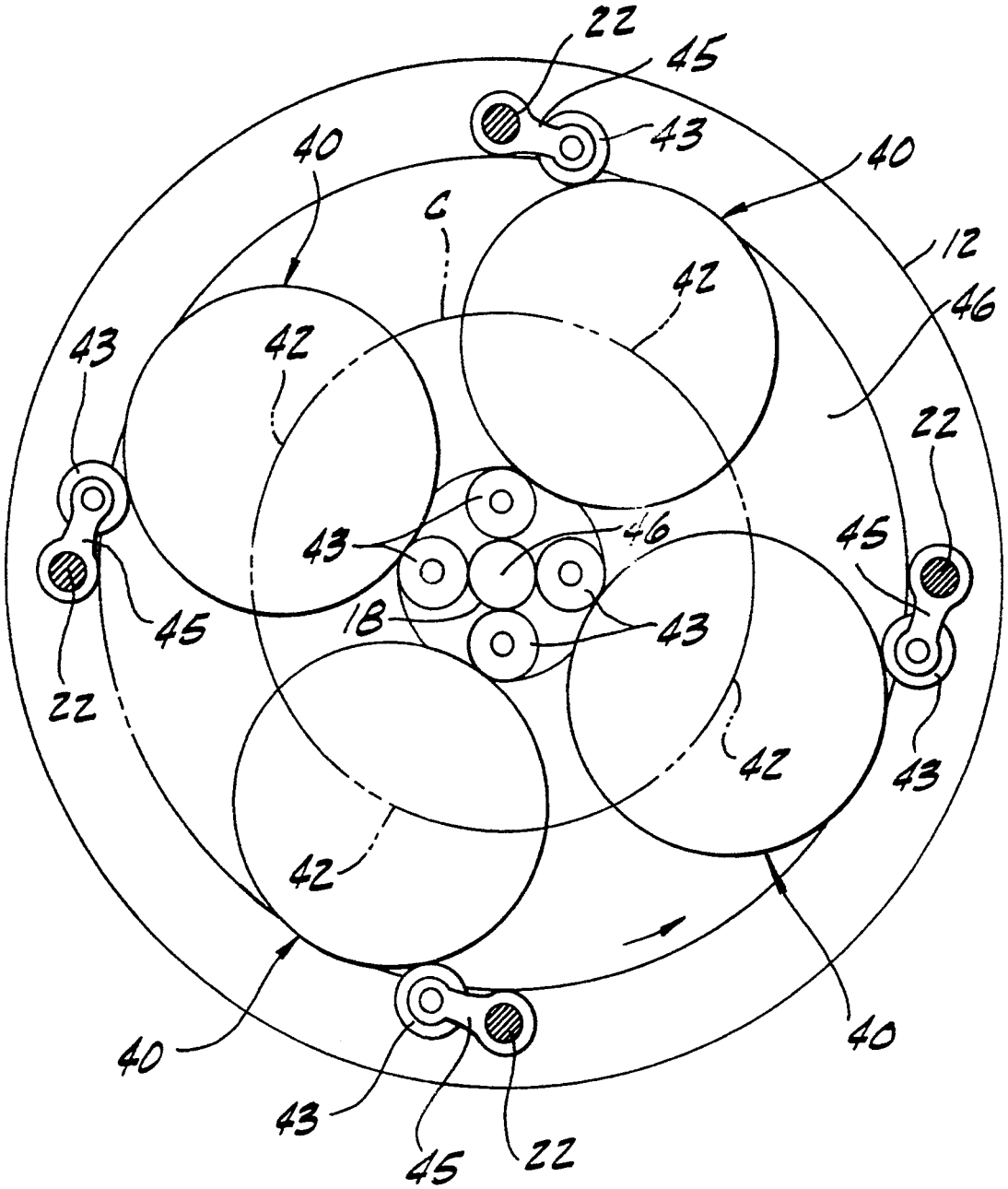
FIG. 5 is a schematic horizontal section of the polishing apparatus showing the pressure plates on the polishing pad as viewed from above.

Each pressure plate 40 is attached to a respective arm 38 for free rotation relative to that arm about a pressure plate axis 42 which is spaced from the turntable axis 16. Rollers 43 are engageable with the pressure plates 40 to assist in holding the plates from rotation about the turntable axis 16, but permitting rotation about the pressure plate axis 42 (FIG. 5). Brackets 45 mount the rollers 43 on the columns 22 and on a roller support 18 depending from the overhead support 20. The overhead support 20, hydraulic cylinders 36 and arms 38 constitute "spindle means" in the illustrated embodiment. However, it is to be understood that the components of the spindle means may be other than described and still fall within the scope of the present invention. The frame 12, turntable 14, roller support 18, overhead support 20, columns 22, cylinders 36, inlet and outlet pipes 41A, 41B, and rollers 43 are all of conventional construction, being of the type present on existing polishing machines.

Figure 2:
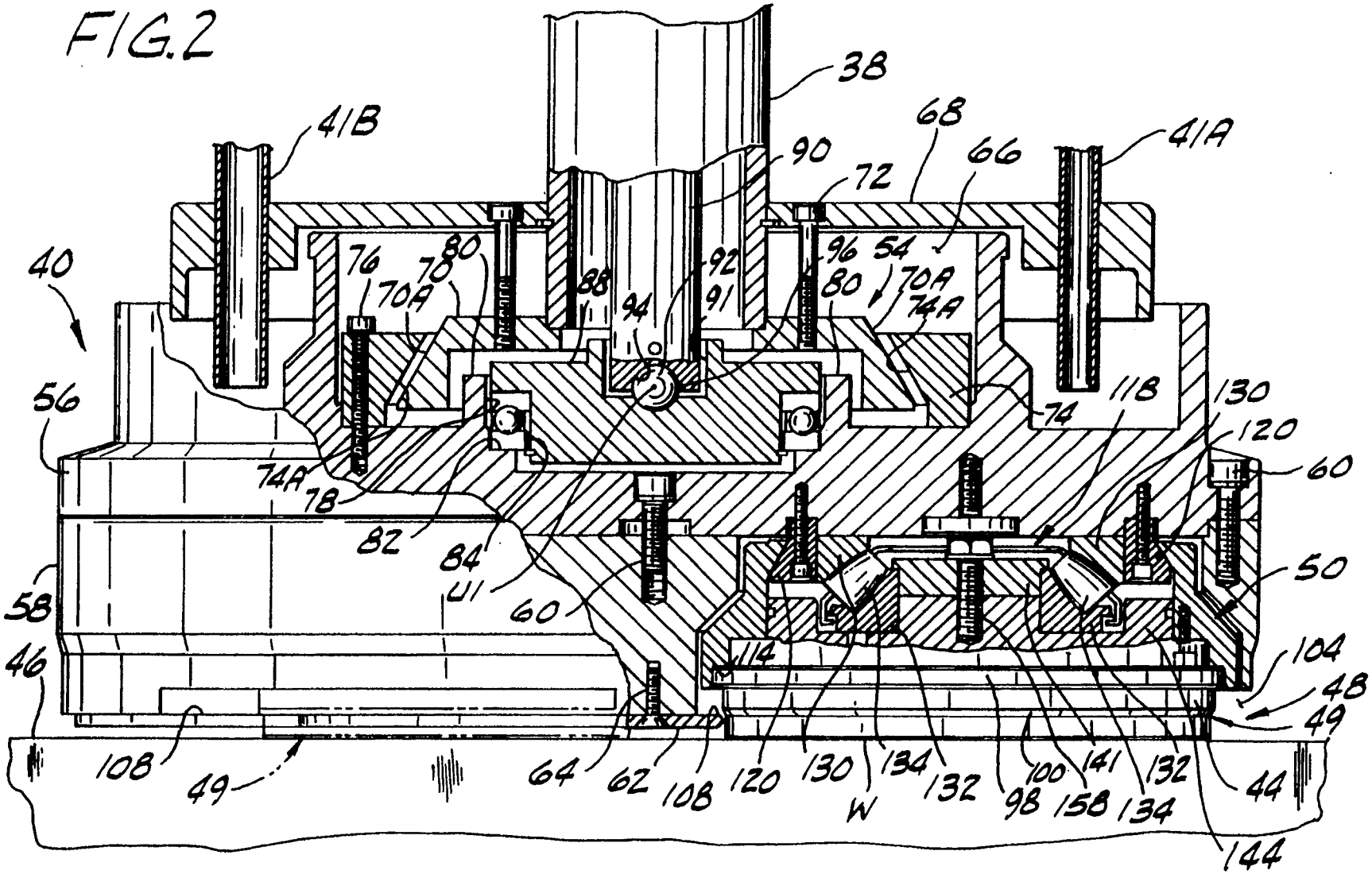
FIG. 2 is an enlarged elevation of one pressure plates with parts broken away to show a floating head assembly therein.
Figure 3:
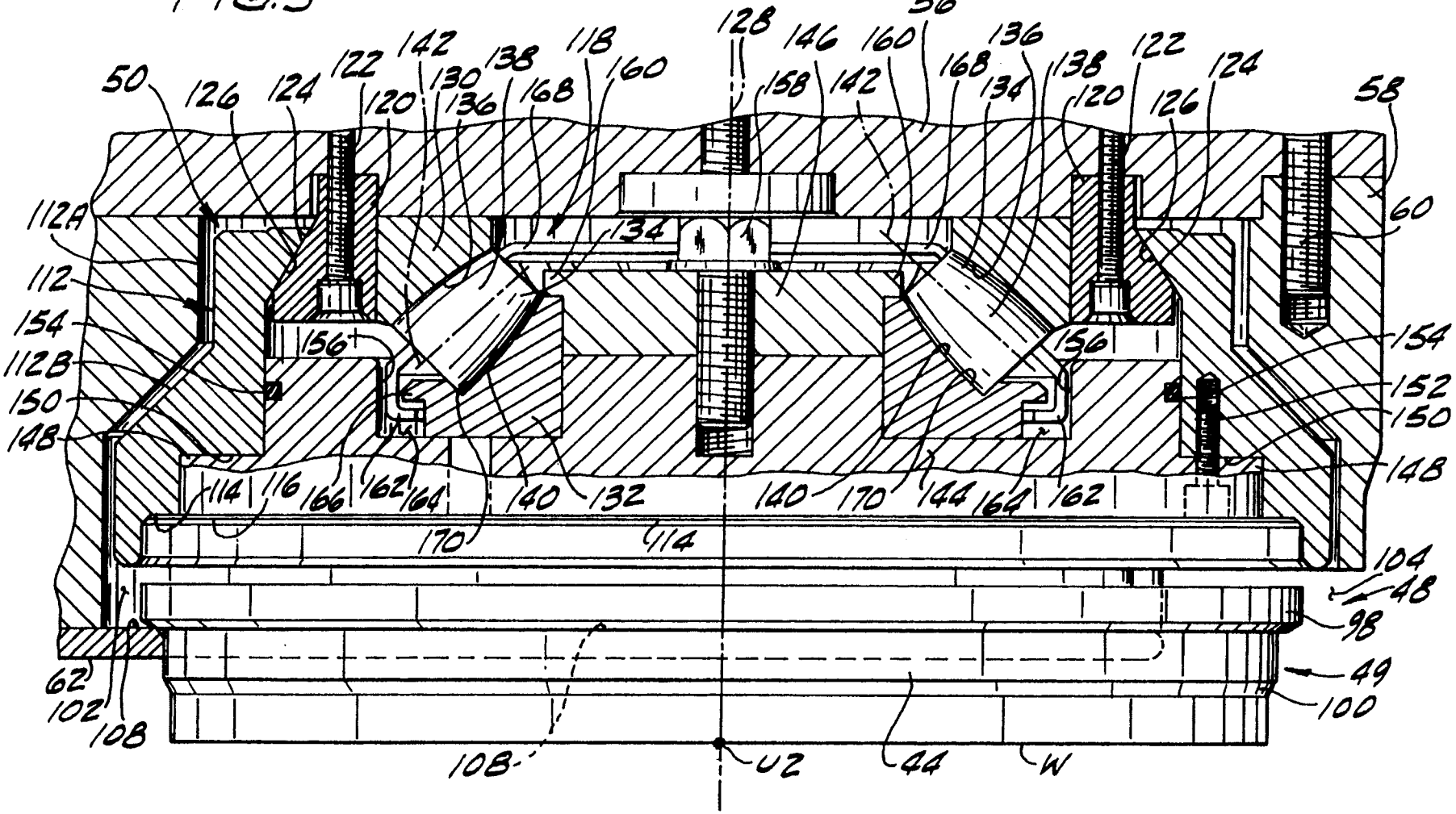
FIG. 3 is a further enlarged fragmentary elevation of the pressure plate of FIG. 2 showing a wafer/wafer carrier unit as inserted into the pressure plate prior to bringing the wafer into engagement with the polishing pad.
Figure 4:
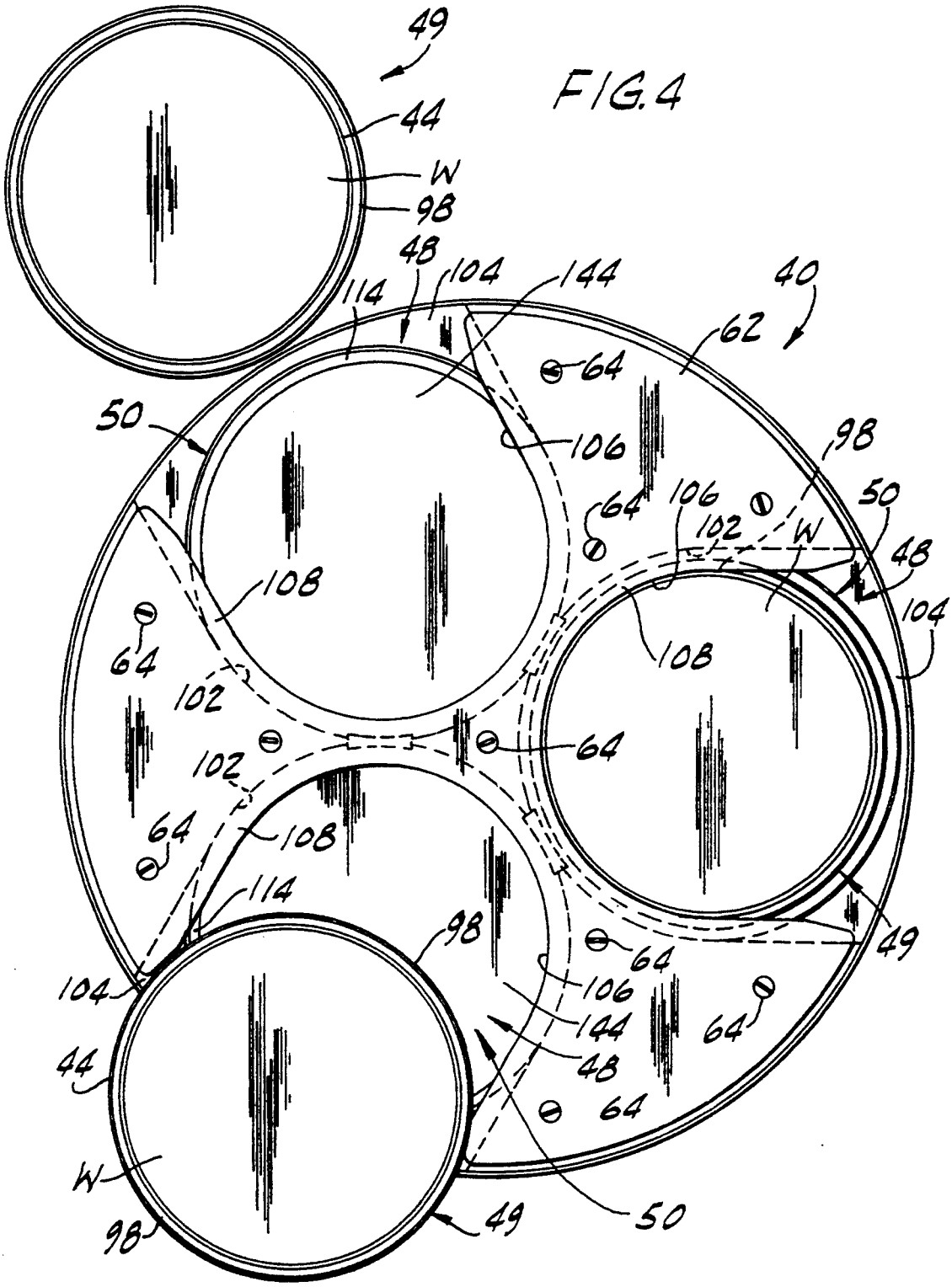
FIG. 4 is a bottom plan view of the pressure plate.

As shown in FIGS. 2 and 3, an article, such as a wafer W made of semiconductor material, may be mounted on one of a plurality of wafer carriers (each designated generally at 44) of the apparatus 10 in a suitable fashion, such as by conventional wax mounting. The pressure plates 40 are constructed for simultaneously holding multiple carriers 44 with a polish face P of the wafers W on the carriers facing a polishing surface of an annular polishing pad 46 (FIG. 2) mounted on the turntable 14 for conjoint rotation about the turntable axis 16. As shown in FIG. 4, each pressure plate 40 has three carrier stalls indicated generally at 48 and constructed for receiving a wafer carrier 44 and mounted wafer W (the unit formed by the wafer carrier and wafer mounted thereon being designated generally by the reference numeral 49). The hydraulic cylinders 36 are operable to raise the pressure plates 40 above the turntable 14 for loading and unloading the wafer carriers 44 from the wafer carrier stalls 48 in the pressure plates. The pressure plates 40 may also be lowered by the hydraulic cylinders 36 to bring the wafers W into engagement with the polishing surface of the polishing pad 46 on the turntable 14. The cylinders 36 (broadly, "force applicating means") apply a downward force on the pressure plates 40 to press the wafers W against the polishing pad 46 with sufficient force to produce the necessary finish on the polish face P of the wafers.

Floating head assemblies, indicated generally at 50, within the carrier stalls 48 operatively connect the wafer carriers 44 (and wafers W) to the pressure plate 40 for independently reorienting each carrier and wafer relative to the pressure plate in response to pressure differentials over the polish face P of the wafer to substantially equalize the pressure distribution over the polish face of the wafer. The structure and function of the floating head assemblies 50 will be described in more detail hereinafter. In the preferred embodiment, the floating head assemblies 50 comprise the "connecting means" set forth in the claims. However, it is to be understood that the connecting means may take other forms and still fall within the scope of the present invention.

As shown in FIG. 2, each pressure plate 40 is connected by a universal joint assembly, designated generally at 54, which permits rotation about the pressure plate axis 42 and universal pivoting motion about a point U1 on the pressure plate axis. The pressure plate 40 includes an upper member 56 connected to a lower member 58 by suitable fasteners 60. The bottom face of the lower member 58 is covered by a sheet of material 62 attached to the lower member by fasteners 64. The upper member 56 has an upwardly opening primary recess 66 in which the universal joint assembly 54 is received. A cover plate 68 mounted on the arm 38 closes the open upper end of the primary recess 66. The universal joint assembly 54 includes a first connector plate 70 suspended from the cover plate 68 in the primary recess 66 by fasteners 72. A second connector plate 74 is mounted by fasteners 76 (only one is shown) on the upper member 56 of the pressure plate 40. The first and second connector plates 70, 74 have generally frustoconically shaped bearing surfaces, designated 70A and 74A, respectively, opposing each other in a spaced relation. When the arm 38 of the cylinder 36 is retracted to raise the pressure plate 40 above the polishing pad 46, the bearing surfaces 70A, 74A engage, and the pressure plate moves upwardly with the arm. However, when the pressure plate 40 is lowered (as depicted in FIG. 2), the space between the bearing surfaces 70A, 74A of the connector plates permits rotational and universal pivoting motion between the arm 38 and the pressure plate.

A secondary recess 78 located within the primary recess 66 of the upper member 56 of the pressure plate 40 is defined in part by a circular wall 80 integral with the upper member 56 and an annular shoulder 82 which supports a roller bearing assembly 84. A plug 86 received in the secondary recess 78 has an annular flange 88 located in generally opposing relation with the shoulder 82 and engaging the bearing assembly 84 to hold the bearing assembly in place. The bearing assembly 84 permits rotary movement of the pressure plate 40 relative to the plug 86 (and hence arm 38) about the pressure plate axis 42. Universal pivoting motion is achieved through a ball-joint connection of the plug 86 to a spindle rod 90 located within the cylinder arm 38. The spindle rod 90 projects out of the open lower end of the arm 38 and into a hole 91 in the top of the plug 86. The upper portion of a ball 92 is received in a generally hemispherical socket 94 in the lower end of the spindle rod 90. A corresponding socket 96 in the plug 86 at the bottom of the hole receives the lower portion of the ball 92. There is sufficient spacing between the spindle rod 90 and the sides of the hole 91, and between the lower end of the rod and the bottom of the hole to permit the pressure plate 40 to pivot a predetermined amount about any axis lying in a horizontal plane and passing through a universal pivot point U1 located in the center of the ball 92. It is to be understood that the pressure plate 40 does not have to be capable of pivoting about universal pivot point U1 to fall within the scope of the present invention.

The wafer carriers 44 are made of a ceramic or other suitable material, and are each generally disk shaped with an outwardly projecting annular lip 98 at its upper end, and a beveled lower peripheral edge 100 (FIG. 3). As stated above, a wafer W may be mounted on the bottom of the carrier 44 by suitable methods such as conventional wax mounting. The resultant wafer/wafer carrier unit 49 may be slid into one of the wafer carrier stalls 48 in the pressure plate 40. The wafer carrier stalls 48 are defined by openings 102 through the lower member 58 of the pressure plate which are closed at the top by the upper member 56. As viewed from the bottom of the pressure plate 40 (FIG. 4), the openings 102 have a generally horseshoe shape with a radially outwardly opening mouth 104. The width of the openings 102 is larger than the largest diameter of the wafer carrier 44. The sheet of material 62 affixed to the bottom face of the pressure plate 40 has three horseshoe shaped openings 106 corresponding to the openings 102 in the lower member 58 of the pressure plate. However, the width of each opening 106 in the sheet 62 is less than the width of the corresponding opening 102 in the lower member 58 such that an edge margin of the sheet at the opening 106 defines a retaining flange 108 projecting inwardly from the lower edges of the opening 102. When the wafer/-wafer carrier unit 49 is slid radially inwardly through the mouth 104 into the wafer carrier stall 48, the lip 98 of the wafer carrier 44 rests on the retaining flange 108, but the wafer W and the portion of the wafer carrier below the lip extend through the opening 106 in the sheet below the pressure plate 40. The retaining flange 108 thus holds the wafer/wafer carrier unit 49 from falling out of the wafer carrier stall 48.

As shown in FIG. 3, the floating head assembly 50 in the wafer carrier stall 48 includes a generally annular floating head, indicated generally at 112, having a generally cylindrical upper portion 112A and an outwardly flaring lower or wafer carrier engaging portion 112B. The floating head 112 is formed with a first interior shoulder 114 adjacent to the bottom of the floating head. The floating head 112 is constructed and dimensioned so that when the pressure plate 40 is forced downward and brings the wafers into engagement with the polishing pad 46, the wafer W and wafer carrier 44 are forced upward into the floating head with the lip 98 at the top of the wafer carrier 44 engaging the first interior shoulder 114 of the floating head. At least the first shoulder 114 and portions adjacent thereto which engage the wafer carrier 44 are covered with a high-friction material 116. The wafer carrier 44 and floating head 112 are effectively fixed to one another for conjoint movement solely by the pressure applied by the cylinder 36, without any mechanical or adhesive interconnection.

In the preferred embodiment, the floating head 112 is mounted on the pressure plate 44 by a conic bearing assembly (designated generally 118) and by a mounting ring 120 affixed by fasteners 122 to the upper member 56 of the pressure plate 40 and disposed interiorly of the upper portion 112A of the floating head. The mounting ring 120 has an annular sloped bearing surface 124 which engages an annular bearing surface 126 formed on the interior of the upper portion 112A to support the floating head 112. The bearing surface 126 of the floating head has a slope complementary to that of the bearing surface 124. The bearing surface 126 is capable of sliding over the bearing surface 124 to permit the floating head 112 to pivot about a universal pivot point U2, and to rotate about a generally vertical wafer or floating head axis 128 relative to the mounting ring 120 and the pressure plate 40.

The conic bearing assembly 118 comprises an annular first raceway defining member 130 mounted on the upper member 56 of the pressure plate 40, an annular second raceway defining member 132 associated with the floating head 112, and a plurality of generally barrel-shaped roller bearings 134 located in the raceway defined by the first and second members. The first raceway defining member 130 has a bearing face 136 having the shape of an annular spherical section engaging a rolling surface 138 of each roller bearing 134 which has a complementary spherical-section contour. The rolling surface 138 of the bearing 134 also engages a bearing face 140 of the second raceway defining member 132 which has the shape of an annular spherical section. The conic bearing assembly 118 is constructed so that the rolling surfaces 138 of the roller bearings 134 freely roll about a roll axis 142 of the bearings for permitting the second raceway defining member 132 and the floating head 112 to rotate about the vertical floating head axis 128 relative to the first raceway defining member 130 and the pressure plate 40. The rolling surface 138 will also slide over the bearing face 136 of the first raceway defining member 130 about the universal pivot point U2 located on the floating head axis 128 to permit universal pivoting motion of the floating head relative to the pressure plate 40 about the universal pivot point.

The second raceway defining member 132 is rigidly attached to the floating head 112 by a support plate 144 and a clamp plate 146. The support plate 144 is generally circular in shape and has a flange 148 engaging a second shoulder 150 formed in the interior of the floating head 112. The support plate 144, which is secured to the floating head by fasteners 152 (only one is shown)

received through the flange 148 and into the floating head 112, closes off the interior of the floating head (and the conic bearing assembly 118 therein) from the polishing pad 46 and abrasive and chemically reactive chemicals of the polishing slurry applied to the pad. An O-ring 154 in a circumferential groove in the support plate 144 seals the support plate with the floating head 112 to prevent the incursion of debris and chemicals from the polishing pad 46 below which could damage the conic bearing assembly 118.

The second raceway defining member 132 rests in a circular channel 156 in the upper face of the support plate 144 and against an interior wall of the channel. The lower portion of the clamp plate 146 is received into the central opening of the annular second raceway defining member 132 and is secured by a fastener 158 to the support plate 144. A circumferentially extending lip 160 at the upper end of the clamp plate 144 overlies and engages the second raceway defining member 132 for clamping it against the support plate 144. A curved retaining prong 162 projecting from the lower end of each roller bearing 134 extends into an opening 164 in the channel 156 between the second raceway defining member 132 and an outer wall of the channel. The retaining prong 162 extends under a lip 166 formed on the second raceway defining member. Another retaining prong 168 projects outwardly from the top of each roller bearing 134. In ordinary operation of the polishing apparatus 10, the prongs 162, 168 will not engage any component of the floating head assembly 50. The roller bearings 134 are held in the raceway by a notch 170 at the bottom of the second raceway defining member 132 which receives a portion of the lower ends of the roller bearings to prevent the roller bearing from moving downwardly from between the raceway defining members 132, 134, and by the tapered shape of the roller bearings which prevents the roller bearings from moving upwardly from between the raceway defining members.

OPERATION

The method of the present invention for polishing wafers W of semiconductor material is generally carried out in the operation of the polishing apparatus 10 described above, but is not limited to the operation of this particular apparatus. Semiconductor wafers W to be polished may be provided in a conventional fashion. Sorting of the wafers into groups of similar thicknesses is not required before selecting wafers to be mounted on the same pressure plate. It is believed that differences in thicknesses in a range at least as wide as $\pm 30\times 10^{-6}$m among the wafers W mounted on a single plate 40 will have no significant effect on the quality of the polish or mechanical characteristics of the wafers. Thickness variations outside this range do not typically occur in ordinary silicon wafer production prior to polishing. The selected wafers W are mounted on individual wafer carriers 44 to form wafer/wafer carrier units 49, which are slid through the mouths 104 in the pressure plate 40 and into the wafer carrier stalls 48.

In the illustrated embodiment, there are three wafer carrier stalls 48 for each pressure plate 40 in which wafer/wafer carrier units 49 are inserted. FIG. 4 shows one wafer/wafer carrier unit 49 fully inserted in a carrier stall 48, another partially installed and a third just outside the carrier stall. The pressure plate 40 is in a raised position and the lip 98 of the wafer carrier 44 rests on the retaining flange 108 below the floating head 112, as shown in FIG. 3. The cylinder 36 is activated to lower the pressure plate 40 and press the polish face P of the wafer against the polish surface of the polishing pad 46 on the turntable 14. The pressure against the polish face P pushes the wafer/wafer carrier unit 49 upward until the lip 98 of the wafer carrier 44 engages the high friction material 116 on the first shoulder 114 in the floating head 112. The pressure of the engagement and the high friction material 116 on the first shoulder holds the wafer carrier and floating head together for conjoint movement.

Differences in thickness between the wafers W in the different wafer carrier stalls 48 in one of the pressure plates 40 tends to tilt the pressure plate. However in that event, the floating head assembly 50 in each wafer carrier stall 48 will experience differences in pressure over the polish face P of the wafer. The conic bearing assembly 118 will pivot the floating head 112 in response to the experienced pressure differentials to reorient the wafer to substantially equalize the pressure distribution over the polish face of the wafer. Moreover, the pressure applied to the wafer W in each stall 48 is substantially equalized. Reorientation is accomplished independently for each wafer W by pivoting motion of the floating head 112 about any horizontal axis which passes through the universal pivot point U2.

It is to be understood that the floating head assembly 50 permits reorientation of the wafer about the pivot point whenever pressure differentials are experienced over the polish face P of the wafer W. Pressure differentials may be caused by conditions other than differences in thickness of the wafers W in the pressure plate 40. For instance, when a leading edge of a wafer W encounters a concentration of abrasive particles from the slurry at a location on the pad 46 during polishing, there is a tendency for the friction force between the wafer and pad to have a vertical component, causing the pressure experienced over the polish face P to vary. The floating head assembly 50 will again permit pivoting to reorient the wafer so the pressure is substantially constant over the face. Thus, the polishing pressure remains more nearly the same over the entire polish face P of each wafer so that a uniform, high-quality finish is obtained.

The universal pivot point U2 is located at the center of a sphere on which the bearing face 136 of the first raceway defining member 132 lies. In the preferred embodiment, the pivot point U2 is located at or very near the interface of the polish face P of the wafer and the polish surface of the pad 46. This location of the pivot point U2 is preferred because the substantial friction force between the pad 46 and the wafer W as the pad moves under the wafer does not induce undesirable pivoting about the pivot point. The friction force vector, which is perpendicular to the vertically downward normal force applied by the cylinder 36, is directed generally horizontally along the polish face/pad interface. No torque causing the floating head 112 to pivot about the pivot point U2 is produced by the friction force because the friction force vector passes generally through the pivot point.

The floating head 112 and wafer/wafer carrier unit 49 are also free to rotate about the floating head axis 128, which is spaced from the axis of rotation 42 of the pressure plate 40. The frictional interaction of the wafers W with the polishing pad 46 causing the floating heads 112 and wafers to rotate rapidly about the floating head axis 128. The pressure plate 40 also rotates about the pressure plate axis 42 carrying the wafers W from a radially interior to a radially exterior location on the polishing pad. The speed of rotation of each wafer W slows as the wafer approaches a circle C (FIG. 5) which has its center on the turntable axis 16 and intersects the pressure plate axis of rotation 42 of all of the pressure plates 40. Once on the other side of the circle, the direction of rotation of the wafer W is opposite. The free rotation of the wafers W relative to the pressure plate 40 allows all points on the polish face P of the wafer to have substantially identical, epicycloidal working pathways. In the past, where the wafers W were fixedly mounted on the pressure plate, each point on the polish face P of the wafer was confined to its own circular movement about the pressure plate axis. A greater identity of working pathways for all points on the polish face P produces greater uniformity in the finish of the wafer.

The free rotation of the wafers W relative to the pad 46 isolates the pressure plate 40 from the wrenching force which would be experienced if the wafers were rigidly attached to the pressure plate. The independent pivoting motion of the wafer W about the pivot point U2 also isolates the pressure plate 40 from at least some of the forces encountered during polishing. Since many of the forces and vibrations experience by each wafer W during polishing are not transmitted to the pressure plate 40, they are also not transmitted to the other wafers W on the plate. Thus, the polishing method of the present invention combines the high yield and quality heretofore associated with single-wafer polishing with the throughput achieved by batch processing. It is believed that TTV and STIR readings of the wafers after polishing are better by at least a factor of 2 over wafers polished using existing polishing machines and methods.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Wafer polishing apparatus comprising:

a turntable having a polishing surface thereon;

a frame mounting the turntable for rotation relative to the frame about an axis;

a pressure plate constructed for simultaneously holding multiple wafers with a polish face of the wafers facing the polishing surface of the turntable;

spindle means mounting the pressure plate for rotation about an axis spaced from the axis of rotation of the turntable, the pressure plate being held from rotation about the axis of rotation of the turntable;

force applicating means for applying a force to the pressure plate to press the wafers against the polishing surface of the turntable;

means operatively connecting each wafer to the pressure plate for reorienting the wafer relative to the pressure plate in response to pressure differentials over the polish face of the wafer engaging the polishing surface to substantially equalize the pressure distribution over the polish face of the wafer;

said connecting means being constructed to permit universal pivoting motion of the wafer relative to the pressure plate about a predetermined universal pivot point.

2. Wafer polishing apparatus as set forth in claim 1 wherein the universal pivot point is located closely adjacent the polishing surface.

3. Wafer polishing apparatus as set forth in claim 2 wherein the universal pivot point is located at the interface of the polish face of the wafer and the polishing surface.

4. Wafer polishing apparatus as set forth in claim 3 wherein said connecting means is constructed to permit rotation of the wafer relative to the pressure plate about an axis of rotation spaced from the axis of rotation of the pressure plate.

5. Wafer polishing apparatus as set forth in claim 4 wherein the universal pivot point lies on the axis of rotation of the wafer.

6. Wafer polishing apparatus as set forth in claim 1 wherein said connecting means comprises a floating head adapted to secure a wafer for conjoint movement therewith and a conic bearing assembly mounting the floating head on the pressure plate for rotation about an axis of rotation spaced from the axis of rotation of the pressure plate and universal pivoting movement of the floating head about a point on the axis of rotation of the floating head.

7. Wafer polishing apparatus comprising:

a turntable having a polishing surface thereon;

a frame mounting the turntable for rotation relative to the frame about an axis;

a pressure plate constructed for simultaneously holding multiple wafers with a polish face of the wafers facing the polishing surface of the turntable;

spindle means mounting the pressure plate for rotation about an axis spaced from the axis of rotation of the turntable, the pressure plate being held from rotation about the axis of rotation of the turntable;

force applicating means for applying a force to the pressure plate to press the wafers against the polishing surface of the turntable;

means operatively connecting the wafers to the pressure plate for permitting free rotation of the wafers relative to the pressure plate about a wafer axis of rotation spaced from the axis of rotation of the pressure plate and from the axis of rotation of the turntable;

said means operatively connecting the wafers to the pressure plates being constructed to permit motion of the wafer relative to the pressure plate in response to pressure differentials over the polish face of the wafer engaging the polishing surface to substantially equalize the pressure distribution over the polish face of the wafer;

said means operatively connecting the wafers to the pressure plates being further constructed to permit universal pivoting motion of the wafer relative to the pressure plate about a predetermined pivot point.

8. Wafer polishing apparatus as set forth in claim 7 wherein the pivot point lies on the axis of rotation of the wafer.

9. Wafer polishing apparatus as set forth in claim 8 wherein said connecting means comprises a floating head adapted to secure a wafer for conjoint movement therewith and a conic bearing assembly mounting the floating head on the pressure plate for rotation about an axis of rotation corresponding to the axis of rotation of the wafer and universal pivoting movement of the floating head about a point on the axis of rotation of the floating head.

10. Wafer polishing apparatus as set forth in claim 1 wherein said means operatively connecting each wafer to the pressure plate comprises wafer stalls formed in the pressure plate, the wafer stall having a laterally outwardly directed opening sized for receiving the wafer into each wafer stall by generally horizontal movement of the wafer through the laterally outwardly directed opening.

11. A wafer polishing apparatus as set forth in claim 10 wherein said means for operatively connecting each wafer to the pressure plate is constructed for holding the wafer without adhering the wafer to the pressure plate.

12. A wafer polishing apparatus as set forth in claim 11 wherein each wafer stall has a generally downwardly directed opening sized for permitting access of the wafer to the polishing surface of the turntable.

13. A wafer polishing apparatus as set forth in claim 12 wherein each wafer is mounted on a wafer carrier for polishing, and wherein the downwardly directed opening of each wafer stall is sized larger than the wafer but smaller than at least a portion of the wafer carrier whereby the wafer carrier is adapted to engage the wafer stall around the periphery of the downwardly directed opening for restraining the wafer carrier and wafer from falling off of the pressure plate through the downwardly directed opening in the wafer stall.

14. Wafer polishing apparatus for polishing a wafer mounted on a wafer carrier, the apparatus comprising:

a turntable having a polishing surface thereon;

a frame mounting the turntable for rotation relative to the frame about an axis;

a pressure plate for holding at least one wafer with a polish face of the wafer facing the polishing surface of the turntable;

spindle means mounting the pressure plate for rotation about an axis spaced from the axis of rotation of the turntable, the pressure plate being held from rotation about the axis of rotation of the turntable;

force applicating means for applying a force to the pressure plate to press the wafer against the polishing surface of the turntable;

means operatively connecting the wafer and wafer carrier to the pressure plate comprising at least one wafer stall formed in the pressure plate, the wafer stall having a laterally outwardly directed opening sized for receiving the wafer and wafer carrier into the wafer stall by generally horizontal movement of the wafer through the laterally outwardly directed opening.

15. A wafer polishing apparatus as set forth in claim 14 wherein said means for operatively connecting the wafer and wafer carrier to the pressure plate is constructed for holding the wafer and wafer carrier without adhering the wafer or wafer carrier to the pressure plate.

16. A wafer polishing apparatus as set forth in claim 15 wherein the wafer stall has a generally downwardly directed opening sized for permitting access of the wafer to the polishing surface of the turntable.

17. A wafer polishing apparatus as set forth in claim 16 wherein the downwardly directed opening of the wafer stall is sized larger than the wafer but smaller than at least a portion of the wafer carrier whereby the wafer carrier is adapted to engage the wafer stall around the periphery of the downwardly directed opening for restraining the wafer carrier and wafer from falling off of the pressure plate through the downwardly directed opening in the wafer stall.

* * * * *